US011889896B2

(12) United States Patent
Beers et al.

(10) Patent No.: US 11,889,896 B2
(45) **Date of Patent: *Feb. 6, 2024**

(54) ARTICLE OF FOOTWEAR WITH MULTIPLE LAYERS

(71) Applicant: NIKE, Inc., Beaverton, OR (US)

(72) Inventors: Tiffany A. Beers, Portland, OR (US); Nathan T. Gilbreath, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/894,772

(22) Filed: Aug. 24, 2022

(65) Prior Publication Data

US 2022/0400815 A1 Dec. 22, 2022

Related U.S. Application Data

(63) Continuation of application No. 14/614,817, filed on Feb. 5, 2015, now Pat. No. 11,470,918.

(51) Int. Cl.
*A43B 23/02* (2006.01)

(52) U.S. Cl.
CPC ..... *A43B 23/028* (2013.01); *A43B 23/0235* (2013.01); *A43B 23/0265* (2013.01)

(58) Field of Classification Search
CPC ..... A43B 23/028; A43B 23/0235; A43B 23/0265; A43B 23/027; A43B 23/0245
See application file for complete search history.

(56) References Cited

U.S. PATENT DOCUMENTS

| | | | |
|---|---|---|---|
| 2,800,423 | A | 7/1957 | De Swart |
| 4,126,500 | A | 11/1978 | Palanos |
| 4,272,850 | A | 6/1981 | Rule |
| 4,629,858 | A | 12/1986 | Kyle |
| 4,779,361 | A | 10/1988 | Kinsaul |
| 5,536,264 | A | 7/1996 | Hsueh et al. |
| RE37,533 | E | 1/2002 | Beige et al. |
| 7,065,820 | B2 | 6/2006 | Meschter |
| 7,392,605 | B2 | 7/2008 | Hatfield et al. |
| 7,636,974 | B2 | 12/2009 | Meschter et al. |
| 7,754,626 | B2 | 7/2010 | Baron et al. |
| 8,008,599 | B2 | 8/2011 | Meschter |
| 8,084,117 | B2 | 12/2011 | Lalvani |
| 8,225,534 | B2 | 7/2012 | Mueller et al. |
| 8,336,117 | B2 | 12/2012 | Carter et al. |
| 8,549,774 | B2 | 10/2013 | Meschter et al. |
| 8,789,295 | B2 | 7/2014 | Burch et al. |
| 9,609,918 | B2 | 4/2017 | Beers |

(Continued)

FOREIGN PATENT DOCUMENTS

| | | | |
|---|---|---|---|
| EP | 2394523 | A1 | 12/2011 |
| EP | 2484240 | A2 | 8/2012 |

(Continued)

*Primary Examiner* — Bao-Thieu L Nguyen
(74) *Attorney, Agent, or Firm* — Banner & Witcoff, Ltd.

(57) ABSTRACT

An article of footwear has a multi-layer upper, where the outermost layers of the upper are cut into a pattern. The cut portions of the upper are mounted on a contiguous substrate layer so that the edges of the cut portions are visible and perceptible to touch. The upper remains durable in terms of abrasion resistance, ply adhesion, tensile strength, and flex testing.

20 Claims, 11 Drawing Sheets

(56) References Cited

U.S. PATENT DOCUMENTS

| | | | | |
|---|---|---|---|---|
| 9,867,417 | B2 | 1/2018 | Beers et al. | |
| 9,872,539 | B2 | 1/2018 | Beers | |
| 10,413,006 | B2 | 9/2019 | Carter et al. | |
| 11,470,918 | B2 * | 10/2022 | Beers | A43B 23/0235 |
| 2001/0045028 | A1 | 11/2001 | Crane et al. | |
| 2004/0200094 | A1 | 10/2004 | Baychar | |
| 2004/0261295 | A1 | 12/2004 | Meschter | |
| 2005/0076536 | A1 | 4/2005 | Hatfield et al. | |
| 2005/0282454 | A1 | 12/2005 | Meschter et al. | |
| 2006/0059721 | A1 | 3/2006 | Hatfield et al. | |
| 2007/0094896 | A1 | 5/2007 | Hatfield et al. | |
| 2007/0199210 | A1 | 8/2007 | Vattes et al. | |
| 2007/0207286 | A1 | 9/2007 | Craig et al. | |
| 2008/0295263 | A1 | 12/2008 | Meschter et al. | |
| 2010/0024100 | A1 | 2/2010 | Sokolowski et al. | |
| 2011/0061149 | A1 | 3/2011 | Polacco et al. | |
| 2011/0209275 | A1 | 9/2011 | Berns et al. | |
| 2012/0030965 | A1 | 2/2012 | Greene et al. | |
| 2013/0000159 | A1 | 1/2013 | Hatfield et al. | |
| 2013/0303041 | A1 | 11/2013 | Kim | |
| 2013/0326914 | A1 | 12/2013 | Lopez | |
| 2014/0059734 | A1 | 3/2014 | Toronjo | |
| 2014/0075657 | A1 | 3/2014 | Turner | |
| 2014/0101816 | A1 | 4/2014 | Toronjo | |
| 2014/0260281 | A1 | 9/2014 | Innes | |
| 2015/0013184 | A1 | 1/2015 | Beers | |
| 2015/0040429 | A1 | 2/2015 | Beers | |
| 2015/0047230 | A1 | 2/2015 | Beers | |
| 2015/0143641 | A1 | 5/2015 | Hatfield et al. | |
| 2017/0156443 | A1 | 6/2017 | Guyan et al. | |
| 2017/0273406 | A1 | 9/2017 | Kilgore | |
| 2019/0053569 | A1 | 2/2019 | Johnson et al. | |

FOREIGN PATENT DOCUMENTS

| | | | |
|---|---|---|---|
| KR | 100771071 | B1 | 10/2007 |
| WO | 2009009254 | A1 | 1/2009 |
| WO | 2016126344 | A1 | 8/2016 |

* cited by examiner

| Test | Performance for Multi-Layer Material, Cut into Undulate Pattern |
|---|---|
| Stoll Abrasion | 200 cycles before top material layer edges catch |
| Flex – Bally | 100,000 cycles, no failure |
| Flex – Whole Shoe | 70,000 cycles, no failure |
| Ply Adhesion, Dry | .54 kg |
| Ply Adhesion, Wet | .45 kg |
| Tensile, pull in design direction | 22 kg/2.54 cm; 140% elongation<br>22 kg/2.54 cm; 166% elongation |
| Tensile pull across design direction | 16 kg/2.54 cm; 135% elongation<br>14 kg/2.54 cm; 123% elongation |

FIG. 17

ARTICLE OF FOOTWEAR WITH MULTIPLE LAYERS

CROSS-REFERENCE TO RELATED APPLICATIONS

The present application is a continuation of U.S. patent application Ser. No. 14/614,817, filed Feb. 5, 2015 and entitled "Article of Footwear with Multiple Layers." U.S. patent application Ser. No. 14/614,817 is incorporated herein by reference in its entirety.

BACKGROUND

The present invention relates generally to flexible uppers for articles of footwear.

Conventional articles of footwear generally include two primary elements, an upper and a sole structure. The upper is secured to the sole structure and forms a void on the interior of the footwear for comfortably and securely receiving a foot. The sole structure is secured to a lower area of the upper, thereby being positioned between the upper and the ground. In athletic footwear, for example, the sole structure may include a midsole and an outsole. The midsole often includes a polymer foam material that attenuates ground reaction forces to lessen stresses upon the foot and leg during walking, running, and other ambulatory activities. Additionally, the midsole may include fluid-filled chambers, plates, moderators, or other elements that further attenuate forces, enhance stability, or influence the motions of the foot. The outsole is secured to a lower surface of the midsole and provides a ground-engaging portion of the sole structure formed from a durable and wear-resistant material, such as rubber. The sole structure may also include a sockliner positioned within the void and proximal a lower surface of the foot to enhance footwear comfort.

The upper generally extends over the instep and toe areas of the foot, along the medial and lateral sides of the foot, under the foot, and around the heel area of the foot. In some articles of footwear, such as basketball footwear and boots, the upper may extend upward and around the ankle to provide support or protection for the ankle. Access to the void on the interior of the upper is generally provided by an ankle opening in a heel region of the footwear. A lacing system is often incorporated into the upper to adjust the fit of the upper, thereby permitting entry and removal of the foot from the void within the upper. The lacing system also permits the wearer to modify certain dimensions of the upper, particularly girth, to accommodate feet with varying dimensions. In addition, the upper may include a tongue that extends under the lacing system to enhance adjustability of the footwear, and the upper may incorporate a heel counter to limit movement of the heel.

A variety of material elements (e.g., textiles, polymer foam, polymer sheets, leather, synthetic leather) are conventionally utilized in manufacturing the upper. For comfort during wear, an upper may be flexible to conform well to the foot wearing the upper. For stability and performance, the flexibility may be constrained in one or more degrees of freedom. Finally, an upper may utilize a material that provides comfort, flexibility, stability, and performance while also providing a unique aesthetic look.

SUMMARY

In one aspect, the invention provides an upper configured to receive a foot. The upper includes a first textile layer and second textile layer. A compressible material layer is positioned between the first textile layer and the second textile layer. The first textile layer and the compressible material layer are cut into a pattern while the second textile layer remains uncut to form a substrate for the first textile layer and the compressible material layer.

In one aspect the invention provides an article of footwear that includes an upper configured to receive a foot. The upper comprises a first fabric layer, a second fabric layer cut into a first fabric portion and a second fabric portion, and a foam layer disposed between the first fabric layer and the second fabric layer. The foam layer is cut into a first foam portion and a second foam portion, wherein the first fabric portion corresponds to the first foam portion to form a first cut portion and the second fabric portion corresponds to the second foam portion to form a second cut portion. The first fabric layer forms an outer surface of the upper. A sole is associated with the upper around a perimeter of the sole.

In one aspect the invention provides a material designed to be used in an article of footwear. The material includes a first fabric layer cut into a first fabric portion and a second fabric portion, a second fabric layer, and a foam layer disposed between the first fabric layer and the second fabric layer, wherein the foam layer is cut into a first foam portion and a second foam portion. The first fabric portion corresponds to the first foam portion to form a first cut portion and the second fabric portion corresponds to the second foam portion to form a second cut portion. The second fabric layer forms an intact substrate that supports the first cut portion and the second cut portion.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

FIG. 17 shows a table of test data for an embodiment of a multi-layer upper.

DETAILED DESCRIPTION

An article of footwear has a multi-layer upper, where the outer layers of the upper, including the outermost layer of the upper, are cut into a pattern so that the portions of the outer layers of the upper are separable from each other. The multi-layer upper provides increased flexibility for the upper as compared to an upper made of a similar material that lacks any such cuts. The multi-layer upper also provides a unique aesthetic appearance. The multiple layers of the upper may have different properties. For example, the material for some layers may be selected for enhanced abrasion and/or tensile strength, while the material for other layers may be selected for enhanced cushioning properties. The cut portions of the upper are mounted on a substrate layer that is not cut to constrain the movement of the cut portions and to allow the multi-layer upper to retain a desired shape.

Figure 1:
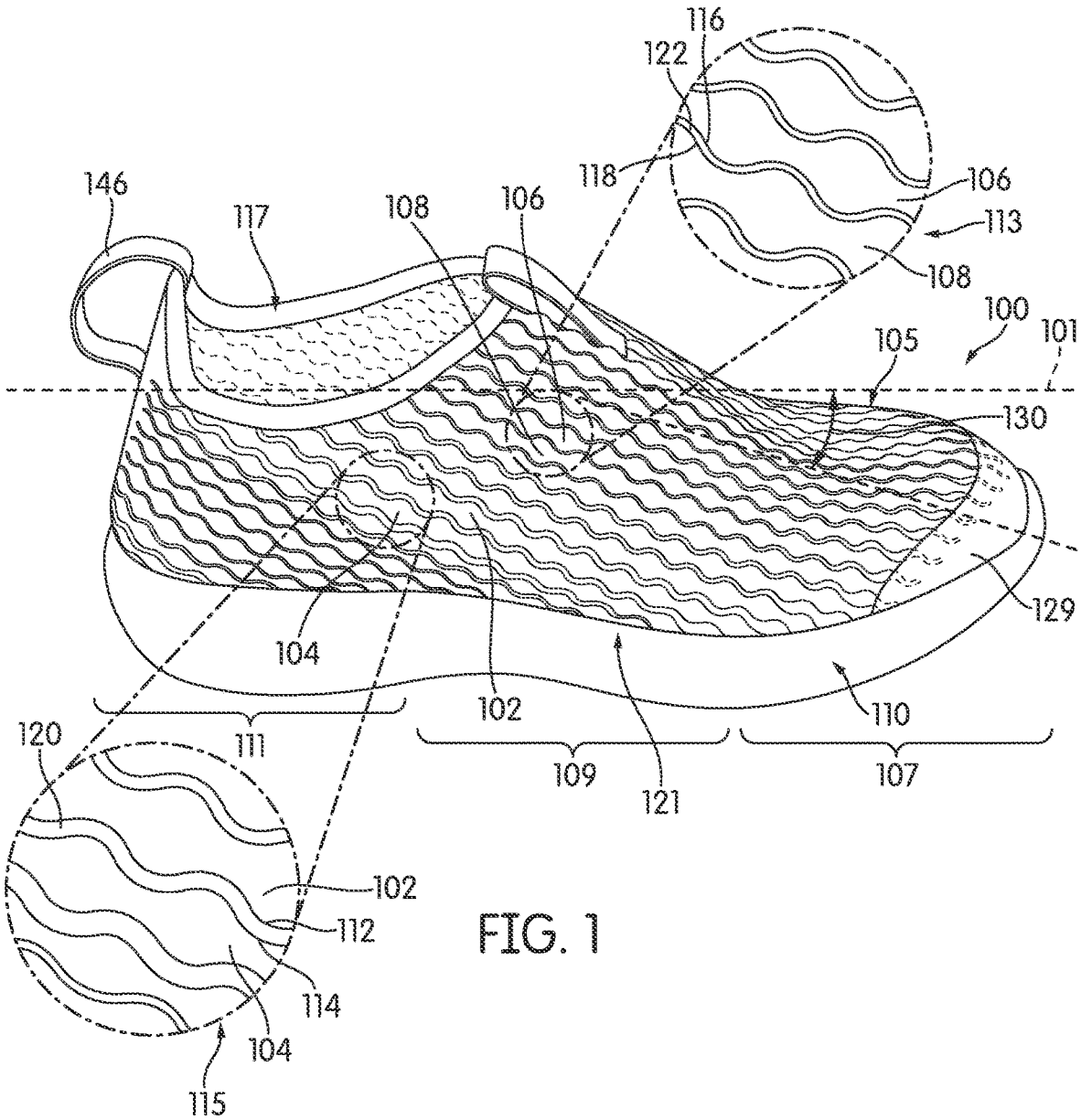
FIG. 1 is a perspective view of an embodiment of an article of footwear having a multi-layer upper.

FIG. 1 shows an embodiment of an article of footwear 100. In some embodiments, article of footwear 100 may include a sole structure 110 and an upper 105. Although article 100 is illustrated as having a general configuration suitable for running, concepts associated with article 100 may also be applied to a variety of other athletic footwear types, including soccer shoes, baseball shoes, basketball shoes, cycling shoes, football shoes, tennis shoes, training shoes, walking shoes, and hiking boots, for example. The concepts may also be applied to footwear types that are generally considered to be non-athletic, including dress shoes, loafers, sandals, and work boots. Accordingly, the concepts disclosed with respect to article 100 may be applied to a wide variety of footwear types.

For reference purposes, article 100 may be divided into three general regions: a forefoot region 107, a midfoot region 109, and a heel region 111, as shown in FIG. 1. Forefoot region 107 generally includes portions of article 100 corresponding with the toes and the joints connecting the metatarsals with the phalanges. Midfoot region 109 generally includes portions of article 100 corresponding with an arch area of the foot. Heel region 111 generally corresponds with rear portions of the foot, including the calcaneus bone. Article 100 also includes a lateral side 121 and a medial side 119, which extend through each of forefoot region 107, midfoot region 109, and heel region 111 and correspond with opposite sides of article 100. More particularly, lateral side 121 corresponds with an outside area of the foot (i.e., the surface that faces away from the other foot), and medial side 119 corresponds with an inside area of the foot (i.e., the surface that faces toward the other foot). Forefoot region 107, midfoot region 109, and heel region 111 and lateral side 121, medial side 119 are not intended to demarcate precise areas of article 100. Rather, forefoot region 107, midfoot region 109, and heel region 111 and lateral side 121, medial side 119 are intended to represent general areas of article 100 to aid in the following discussion. In addition to article 100, forefoot region 107, midfoot region 109, and heel region 111 and lateral side 121, medial side 119 may also be applied to sole structure 110, upper 105, and individual elements thereof.

In an exemplary embodiment, sole structure 110 is secured to upper 105 and extends between the foot and the ground when article 100 is worn. In some embodiments, sole structure 110 may include one or more components, including a midsole, an outsole, and/or a sockliner or insole. In an exemplary embodiment, sole structure 110 may include an outsole that is secured to a lower surface of upper 105 and/or a base portion configured for securing sole structure 110 to upper 105. In one embodiment, outsole 112 may be formed from a wear-resistant rubber material that is textured to impart traction. Although this configuration for sole structure 110 provides an example of a sole structure that may be used in connection with upper 105, a variety of other conventional or nonconventional configurations for sole structure 110 may also be used. Accordingly, in other embodiments, the features of sole structure 110 or any sole structure used with upper 105 may vary.

For example, in other embodiments, sole structure 110 may include a midsole and/or a sockliner. A midsole may be secured to a lower surface of an upper and in some cases may be formed from a compressible polymer foam element (e.g., a polyurethane or ethylvinylacetate (EVA) foam) that attenuates ground reaction forces (i.e., provides cushioning) when compressed between the foot and the ground during walking, running, or other ambulatory activities. In other cases, a midsole may incorporate plates, moderators, fluid-filled chambers, lasting elements, or motion control members that further attenuate forces, enhance stability, or influence the motions of the foot. In still other cases, the midsole may be primarily formed from a fluid-filled chamber that is located within an upper and is positioned to extend under a lower surface of the foot to enhance the comfort of an article.

In some embodiments, upper 105 defines a void within article 100 for receiving and securing a foot relative to sole structure 110. The void is shaped to accommodate the foot and extends along a lateral side of the foot, along a medial side of the foot, over the foot, around the heel, and under the foot. Upper 105 includes an exterior surface and an opposite interior surface. Whereas the exterior surface faces outward and away from article 100, the interior surface faces inward and defines a majority or a relatively large portion of the void within article 100 for receiving the foot. Moreover, the interior surface may lay against the foot or a sock covering the foot. Upper 105 may also include a collar that is located in at least heel region 111 and forms a throat opening 117. Access to the void is provided by throat opening 117. More particularly, the foot may be inserted into upper 105 through throat opening 117, and the foot may be withdrawn from upper 105 through throat opening 117.

Many conventional footwear uppers are formed from multiple material elements (e.g., textiles, polymer foam, polymer sheets, leather, synthetic leather) that are joined through stitching or bonding, for example. Upper 105 is made of a composite material formed of multiple layers of material. Upper 105 is formed from a cut material, where some but not all layers of the composited are cut into a pattern. As described in greater detail below, in some embodiments, the outermost layers of upper 105 are cut into portions, while the interior surface of upper 105 is intact and contiguous so that the interior surface of upper 105 may be a substrate for supporting and constraining the cut portions of upper 105. Thus, upper 105 may include various layers of fabric and/compressible materials, where at least some of the layers are cut into corresponding portions. At least one layer remains intact/uncut or contiguous to hold the other layers together.

Upper 105 may be cut into a pattern so that at least some of the layers of upper 105 may move and flex with respect to each other. This movement may provide a fit that more closely conforms to the contours of a wearer's foot. In the embodiment shown in FIGS. 1 and 2, upper 105 the cut portions are strips with undulating edges, such as first strip 102, second strip 104, third strip 106, and fourth strip 108. In other embodiments, the cut portions may have different shapes, separations, and may cover a different extent of upper 105. In this embodiment, first strip 102 is adjacent to second strip 104 so that a first edge 112 of first strip 102 is proximate a second edge 114 of second strip 104. First edge 112 is separated from second edge 114 by a first separation 120. A third strip 106 is adjacent to fourth strip 108 so that a third edge 116 of third strip 106 is proximate a fourth edge 118 of fourth strip 108. Third edge 116 is separated from fourth edge by a second separation 122.

In this embodiment, the outermost surface of upper 105 is cut so that the separations between the strips, such as first separation 120 and second separation 122, are visible and able to be perceived by touching upper 105. The separations between the strips, such as first separation 120 and second separation 122, may have different widths. In some embodiments, the different widths may be due to the manufacturing of the material. In the embodiment shown in FIG. 1, the different widths may be due to flexing and bending of upper 105 as the material of upper 105 conforms to the natural contours of a wearer's feet.

Upper 105 includes a number of different flexed and unflexed regions, including flexed region 115 and unflexed region 113. In flexed region 115, first separation 120 may be a relatively large gap between first edge 112 and second edge 114. The gap may be due to a bend in upper 105 to accommodate a curve in the contour of upper 105. The gap may also be due to a deformation from use, such as if a wearer consistently bends or flexes upper 105. If article of footwear 100 is being worn, the gap may also be due to deformation from use from a temporary bend or flex of upper 105. In contrast, in unflexed region 113, second separation 122 may be a relatively small gap or no gap between third edge 116 and fourth edge 118. In some embodiments, third edge 116 and fourth edge 118 may be in direct contact with each other along at least a portion of third edge 116 and fourth edge 118. In other embodiments, a relatively small gap separates third strip 106 from fourth strip 108. These flexed and unflexed regions are not necessarily static. For example, as article of footwear 100 is being worn, flexed region 115 may transition into an unflexed region and back to a flexed region as the wearer's foot bends, expands, and contracts within article of footwear. Similarly, unflexed region 113 may transition into a flexed region and back to an unflexed region. In some embodiments, these transitions may happen only once or multiple times. This ability to transition may contribute to the comfort of the wearer, as upper 105 is able to accommodate the movement of the foot within the shoe.

The pattern on multi-layer upper 105 may be any pattern able to be cut into a multi-layered material. In one embodiment, such as the embodiment shown in FIGS. 1 and 2, the pattern is an undulate pattern, i.e., strips with undulating edges, such as first strip 102 and first edge 112. In other embodiments, first edge 112 and opposite edge 132 may have different contours. A portion of a length of first strip 102 is shown in FIG. 3. First edge 112 (i.e., a "first strip edge") has a wavy, sinusoidal shape, where the contour of first edge 112 has peaks and troughs having substantially even separations along the length of first strip 112. In the embodiment shown in FIG. 3, an opposite edge 132 of first strip 102 (i.e., a "second strip edge") has a shape that mirrors that of first edge 112.

While not wishing to be bound by any particular theory of operation, the undulate pattern may be particularly desirable because the strip edges lack points that can catch or snag onto objects and reduce the durability of the upper. Test data shows that this undulate pattern performs well during durability tests. The following tests were performed:

- Stoll abrasion resistance test: Test device rubs sandpaper against a rotating sample while a 1-pound head weight. The test counts the number of rotations until the material begins to catch on the edge of the test device.
- Flex—Bally: Test device repeatedly flexes samples. The material passes the test when the material sample withstands 100,000 cycles.
- Flex—Whole Shoe: Test device flexes the sample shoe 60 degrees in the forefoot area for 70,000 cycles. Any damage is documented.
- Ply adhesion: Test device pulls a coated surface from a backing layer to measure the coating bond strength, the result is the mass needed to cause separation.
- Tensile (fabric/trim): Testing device pulls fabric/leather to break and calculates peak load per unit width.

FIG. 17 shows the test results for a multi-layer upper having an undulate pattern cut into a three-layer composite material with 3-5 mm open cell polyurethane foam sandwiched between layers of EuroWoven ESF material using 50 micron NASA-T adhesive film. Only the foam and one layer of the EuroWoven material are cut into the undulating pattern. The other layer of EuroWoven material remains intact and uncut. The test results show acceptable or greater performance.

Figure 3:
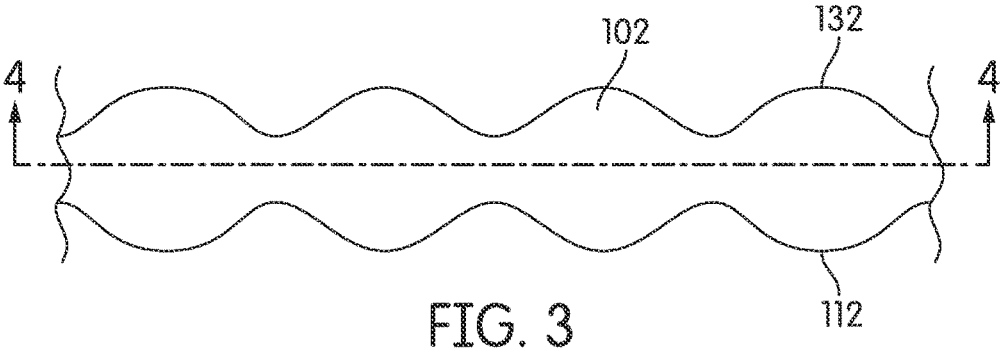
FIG. 3 is a top plan view of an embodiment of a section of a cut portion of an embodiment of a multi-layer upper.
Figure 4:
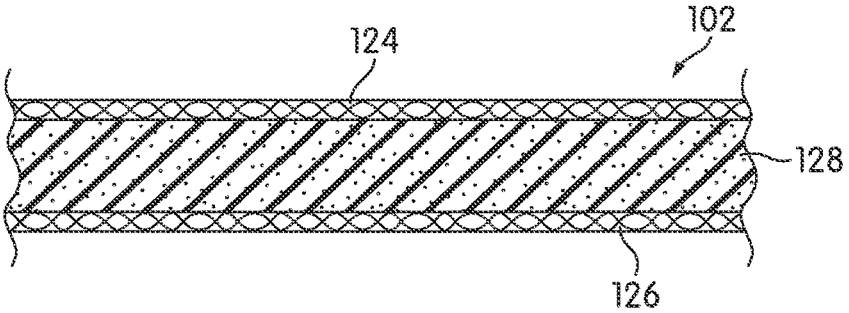
FIG. 4 is a cross-section of the section shown in FIG. 3.

FIG. 4 is a cross-section of the strip portion shown in FIG. 3 that shows the layers of upper 105. In this embodiment, upper 105 is formed from a composite of three layers to accommodate the cutting of the material: a first layer 124, a second layer 126, and a compressible layer 128 sandwiched between first layer 124 and second layer 126. First layer 124, second layer 126, and compressible layer 128 may be associated with each other using any method known in the art, such as with adhesives or by bonding.

Compressible material 128 provides substantially all of the thickness of upper 105, as first layer 124 and second layer 126 are relatively thin layers. Compressible material 128 may be any type of material that can be used in an upper. For example, compressible material 128 may be a nonwoven material, such as cotton or synthetic batting, or a foam, such as foamed polyurethane. In one embodiment, the thickness of compressible material 128 may be between about 1 mm to about 10 mm. In another embodiment, the thickness of compressible material 128 may be between about 3 mm to about 5 mm. In one embodiment, compressible material 128 is open cell polyurethane foam between 3 mm and 5 mm. In one embodiment, compressible material 128 is Ecovina, available from Dahsheng Corporation of Taichung City, Taiwan.

First layer 124 and second layer 126 may be any type of thin, flexible material usable in an upper of an article of footwear. First layer 124 and second layer 126 may be fabrics. First layer 124 and second layer 126 may be formed from knitted, woven, non-woven, spacer, or mesh textile components that include rayon, nylon, polyester, polyacrylic, elastane, cotton, wool, or silk, for example. First layer 124 and second layer 126 may be non-stretch, may exhibit one-directional stretch, or may exhibit multi-directional stretch. Accordingly, a variety of materials are suitable for first layer 124 and second layer 126. Examples of appropriate materials for Tirrenina available from Clarino of Tokyo, Japan, LJ-H135K Synthetic Suede available from Gold Long John International Co., Ltd. of Changhua, Taiwan, and Eurowoven available from ESF of Saint-Julien-en-Saint-Alban, France. In some embodiments, first layer 124 and second layer 126 are made from the same textile material. In other embodiments, first layer 124 and second layer 126 are made from different materials.

Figure 5:
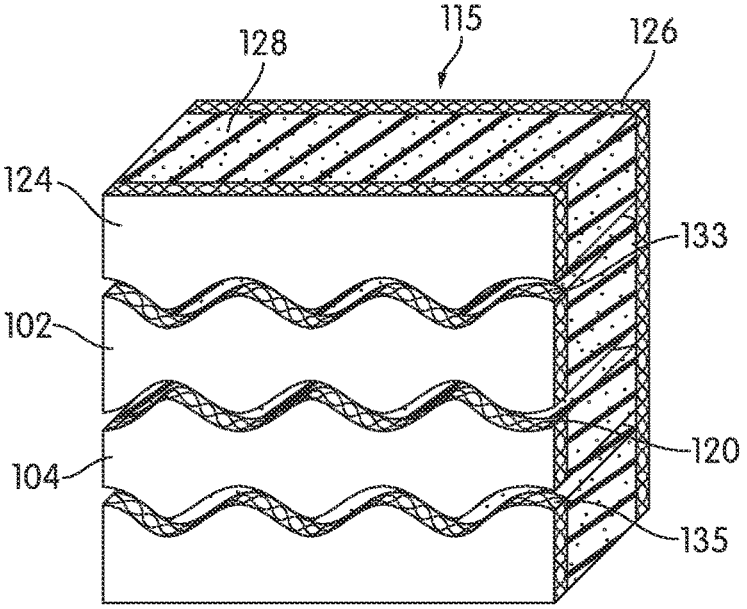
FIG. 5 is a section of an embodiment of a multi-layer upper, showing the cut layers on top.
Figure 6:
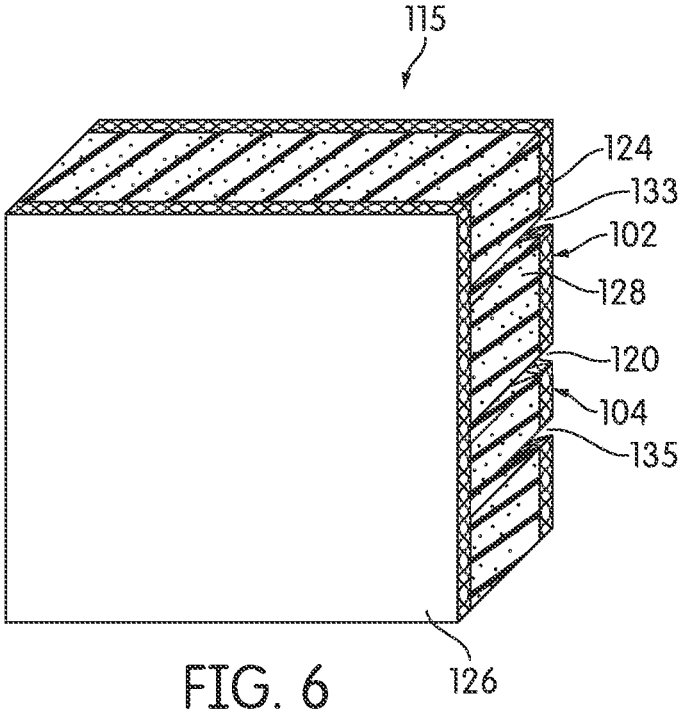
FIG. 6 is the obverse of the section of FIG. 5, showing the uncut layer on top.
Figure 7:
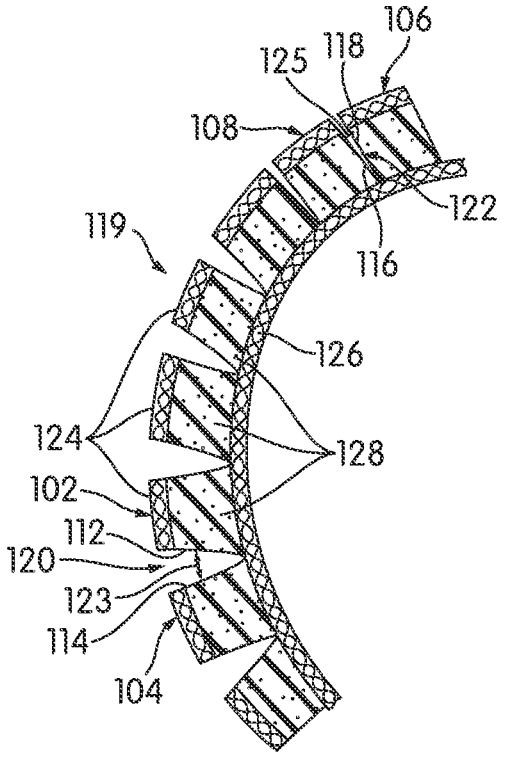
FIG. 7 is a side view of the section shown in FIGS. 5 and 6, showing an embodiment of curvature that may be found in an upper of an article of footwear.

FIGS. 5-7 are portions of upper 105 showing the how the material layers are cut and joined together. FIG. 5 shows flexed region 115 with first strip 102 and second strip 104. First layer 124 is shown on top to show how the separations such as first separation 120, upper separation 133, and lower separation 135 are cut into and through first layer 124 and compressible material 128. These separations entirely disassociate first strip 102 from second strip 104 in first layer 124 and compressible material 128. FIG. 6 shows the obverse side of flexed region 115 to show how second layer 126 remains uncut and contiguous. Thus, second layer 126 forms a substrate onto which first strip 102 and second strip 104 are mounted and supported so that, while first strip 102 and second strip 104 may move relative to each other, that movement is constrained by second layer 126. This constraining feature of second layer 126 allows upper 105 to be cut but still retain its overall shape.

FIG. 7 shows schematically how a portion of upper 105 behaves in cross-section while following the contour of upper 105 (shown in FIG. 1), such as in flexed region 115 (shown in FIG. 1) and in unflexed region 113 (shown in FIG. 1). The curvature of the bend is exaggerated for clarity, though the curvature may be any curvature found in an article of footwear to accommodate the shape of a foot and/or an upper. In this embodiment, first layer 124 forms the outermost surface of upper 105 and second layer 126 forms the innermost surface of upper 105. First textile 124 is visible when article of footwear 100 (shown in FIG. 1) is worn, while second layer 126 would face inward toward a liner or a foot or sock of a wearer when article of footwear 100 is worn.

Second layer 126 follows a curved contour. To accommodate the bend, the strips formed by first layer 124 and compressible material 128, such as first strip 102 and second strip 104, move away from each other or are pushed towards each other, such as third strip 106 and fourth strip 108. Because each of first strip 102 and second strip 104 are joined to contiguous second layer 126, first separation 120 forms a V-shaped gap. First edge 112 and second edge 114 form a first separation width 123 that is widest at first layer 124 and tapers to substantially zero width or the original manufacturing width proximate second layer 126.

Second layer 126 thus constrains the movement of first strip 102 and second strip 104 with respect to each other. In contrast, third strip 106 and fourth strip 108 remain close to each other. Because each of third strip 106 and fourth strip 108 are joined to contiguous second layer 126, second separation 122 forms a V-shape. Third edge 116 and fourth edge 118 define a second separation width 125 that is widest at first layer 124 and tapers to substantially zero width or the original manufacturing width proximate second layer 126. Second layer 126 thus constrains the movement of third strip 106 and fourth strip 108 with respect to each other. The maximum width of first separation width 123 may be greater than the maximum width of second separation width 125.

Figure 2:
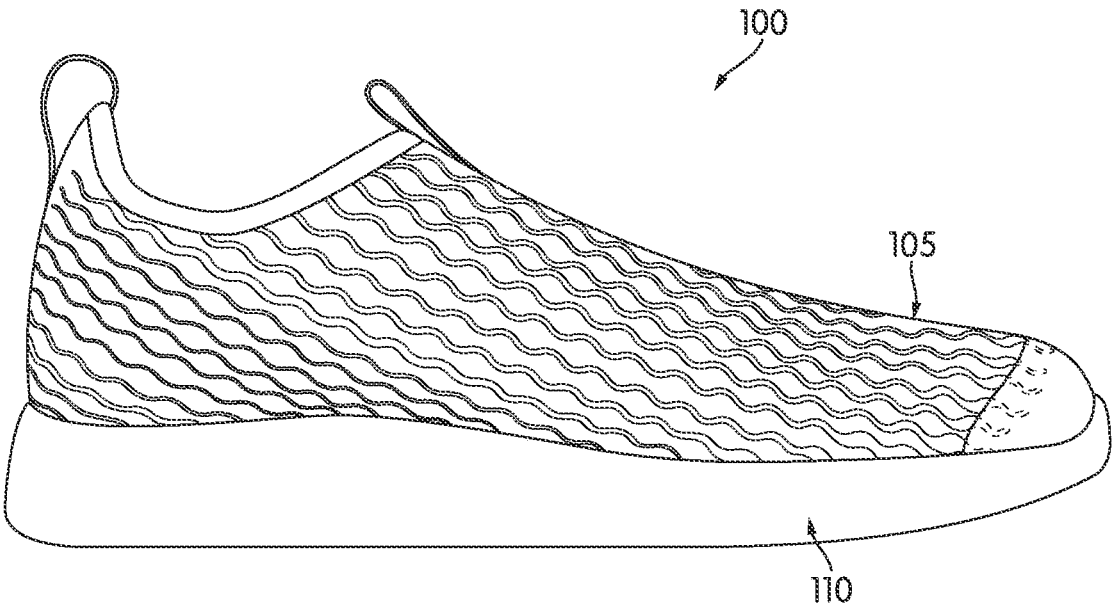
FIG. 2 is a side plan view of a medial side of an embodiment of an article of footwear having a multi-layer upper.
Figure 8:
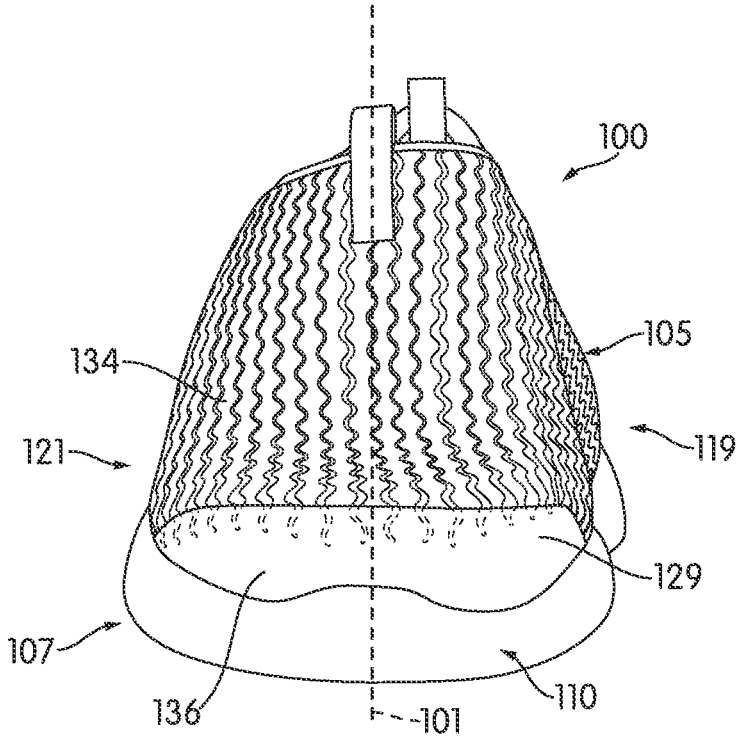
FIG. 8 is a plan view of an embodiment of an article of footwear having a multi-layer upper, the view looking along the article of footwear from the toe of the article of footwear.
Figure 9:
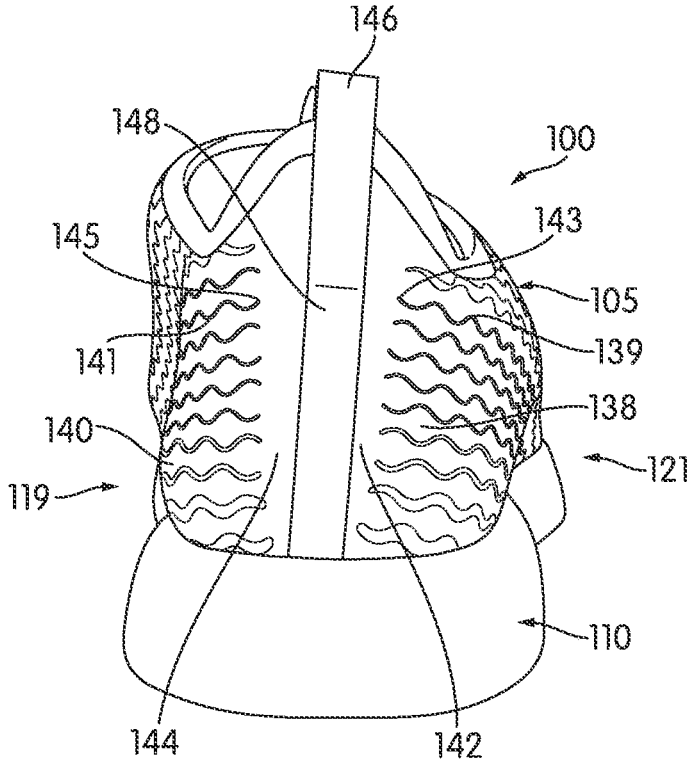
FIG. 9 is a plan view of an embodiment of an article of footwear having a multi-layer upper, the view looking along the article of footwear from the heel of the article of footwear.

In the embodiment shown in FIGS. 1 and 2, the pattern of strips cover substantially all the surface area of upper 105. In other embodiments, only selected portions of upper 105 may be cut, such as to selectively increase flexibility of upper 105. In the embodiments shown in FIGS. 8 and 9, certain portions of upper 105 remain a solid, uncut portion of material. In FIG. 8, a first solid area 136 is positioned in forefoot region 107, proximate sole structure 110. First solid area 136 may be provided to reinforce the material of upper 105 in a high flex and high abrasion region, such as the toe box. In FIG. 9, a second solid, uncut area 142 on lateral side 121 and a third solid, uncut area 144 on medial side 119 may be provided in a heel region 111. Second uncut area 142 and third uncut area 144 may be separated from each other or continuous with each other. Second uncut area 142 and third uncut area 144 may be provided to support a structure such as a pull tab 146 and a pull tab extension 148. Thus, a first cut line 139 on lateral side 121 terminates at first endpoint 143, which is spaced a specified distance from pull tab 146 and pull tab extension 148. That specified distance forms second uncut area 142. Similarly, a second cut line 141 on medial side 119 terminates at second endpoint 145, which is spaced a specified distance from pull tab 146 and pull tab extension 148. That specified distance forms third uncut area 144. Also, a strip such as strip 140 may be considered to be an uncut area, since the material between two separations remains uncut.

Figure 10:
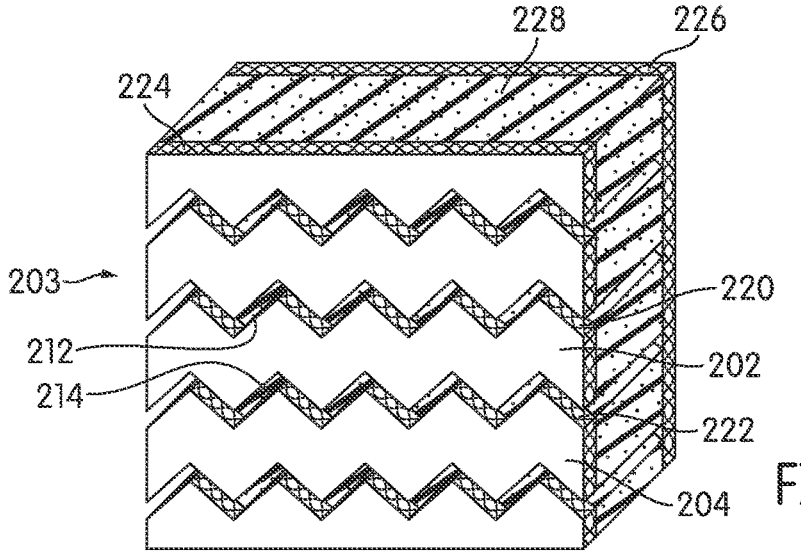
FIG. 10 shows a swatch with a regular zig-zag pattern for a multi-layer upper.
Figure 11:
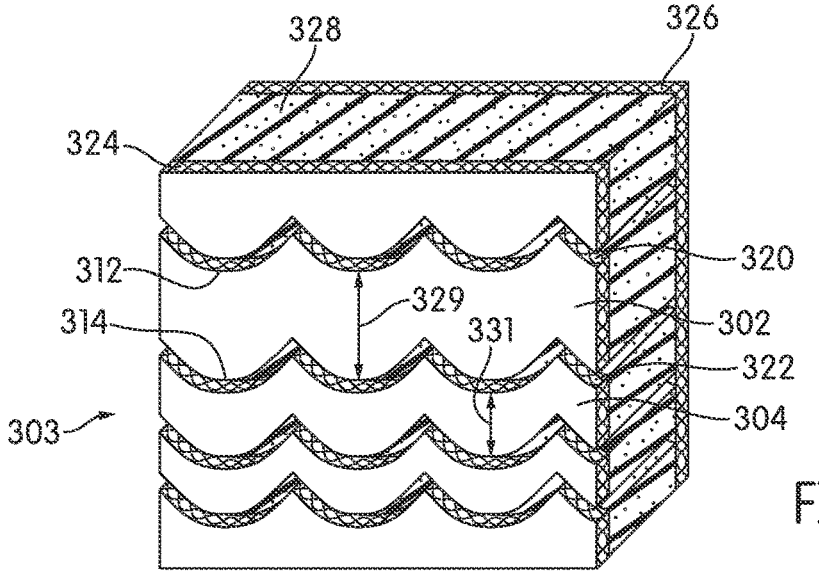
FIG. 11 shows a swatch with a wavy pattern for a multi-layer upper.
Figure 12:
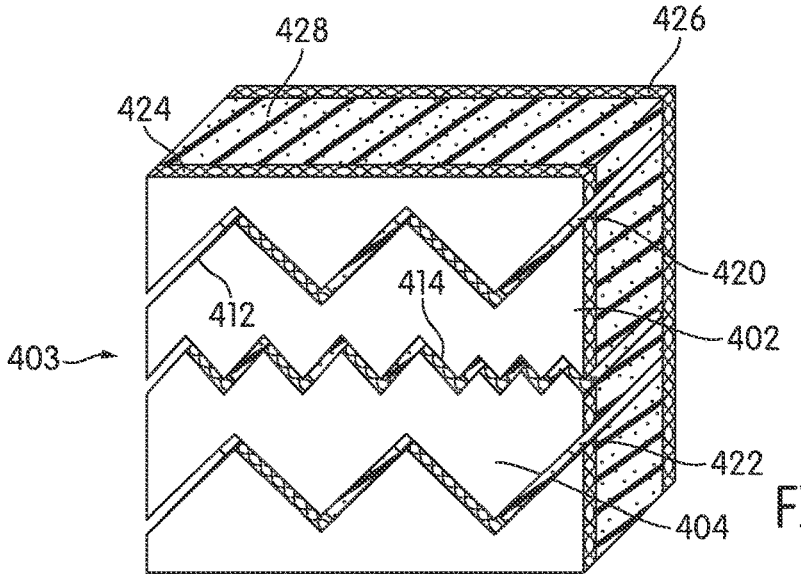
FIG. 12 shows a swatch with an irregular pattern for a multi-layer upper.

The embodiments discussed and shown thus far show a regular, repeating, undulating pattern. However, other patterns are also suitable for use in a multi-layer upper. FIGS. 10-12 show various patterns. In FIG. 10, a second cut composite material 203 is formed from a third textile layer 224, which may be similar to first layer 124 discussed above, and a fourth textile layer 226, which is similar with second layer 126 discussed above. A second compressible material 228 is sandwiched between third textile layer 224 and fourth textile layer 226. A pattern is cut into second cut composite material 203, but only through third textile layer 224 and second composite material 228. This pattern is a regular, evenly spaced apart zig-zag pattern.

A fifth strip 202 includes a fifth edge 212 that defines a side of a third separation 220 and a sixth edge 214 that defines a side of a fourth separation 222. All strip edges such as fifth edge 212 and sixth edge 214 may follow the same zig-zag pattern. Thus fifth strip 202 has a zig-zag shape and is separated from a sixth strip 204, which also has a zig-zag shape, by a third separation 222, which also has a zig-zag shape. Fourth textile layer 226 remains uncut and contiguous to form a substrate for the strips of second cut composite 203.

In FIG. 11, a third cut composite material 303 is formed from a fifth textile layer 324, which is similar to first layer 124 discussed above, and a sixth textile layer 326, which is similar to second layer 126 discussed above. A third compressible material 328 is sandwiched between fifth textile layer 324 and sixth textile layer 326. A pattern is cut into third cut composite material 303, but only through fifth textile layer 324 and third composite material 328. This pattern is a regular wave pattern. However, the wave cutlines are not evenly spaced, so the strips of this pattern have different heights. For example, a seventh strip 302 includes a seventh edge 312 that defines a side of a fifth separation 320 and an eighth edge 314 that defines a side of a sixth separation 322. All strip edges such as seventh edge 312 and eighth edge 314 follow the same wavy pattern. However, seventh strip 302 has a seventh strip width 329 and eighth strip 304 has an eighth strip width 331, where the uneven spacing of the cutlines and separations make seventh strip width 329 greater than eighth strip width 331. Sixth textile layer 326 remains uncut and contiguous to form a substrate for the strips of third cut composite 303.

In FIG. 12, a fourth cut composite material 403 is formed from a seventh textile layer 424, which is similar to first layer 124 discussed above, and an eighth textile layer 426, which is similar to second layer 126 discussed above. A fourth compressible material 428 is sandwiched between seventh textile layer 424 and eighth textile layer 426. A pattern is cut into fourth cut composite material 403, but only through seventh textile layer 424 and fourth compressible material 428. This pattern is an irregular zig-zag pattern. However, the zig-zag cutlines are not the same on each side of a strip, so the strips of this pattern have different edge contours on each side of a strip. For example, a ninth strip 402 includes a ninth edge 412 that defines a side of a seventh separation 420 and a tenth edge 414 defines a side of an eighth separation 422. All strip edges such as ninth edge 412 and a tenth edge 414 are zig-zag contours, however, ninth edge 412 has a regular zig-zag pattern with relatively long legs, while tenth edge 414 has an irregular zig-zag patter with shorter legs than ninth edge 412 along a first length of tenth edge 414 and even shorter legs along a second length of tenth edge 414. Eighth textile layer 426 remains uncut and contiguous to form a substrate for the strips of fourth cut composite material 403.

Figure 13:
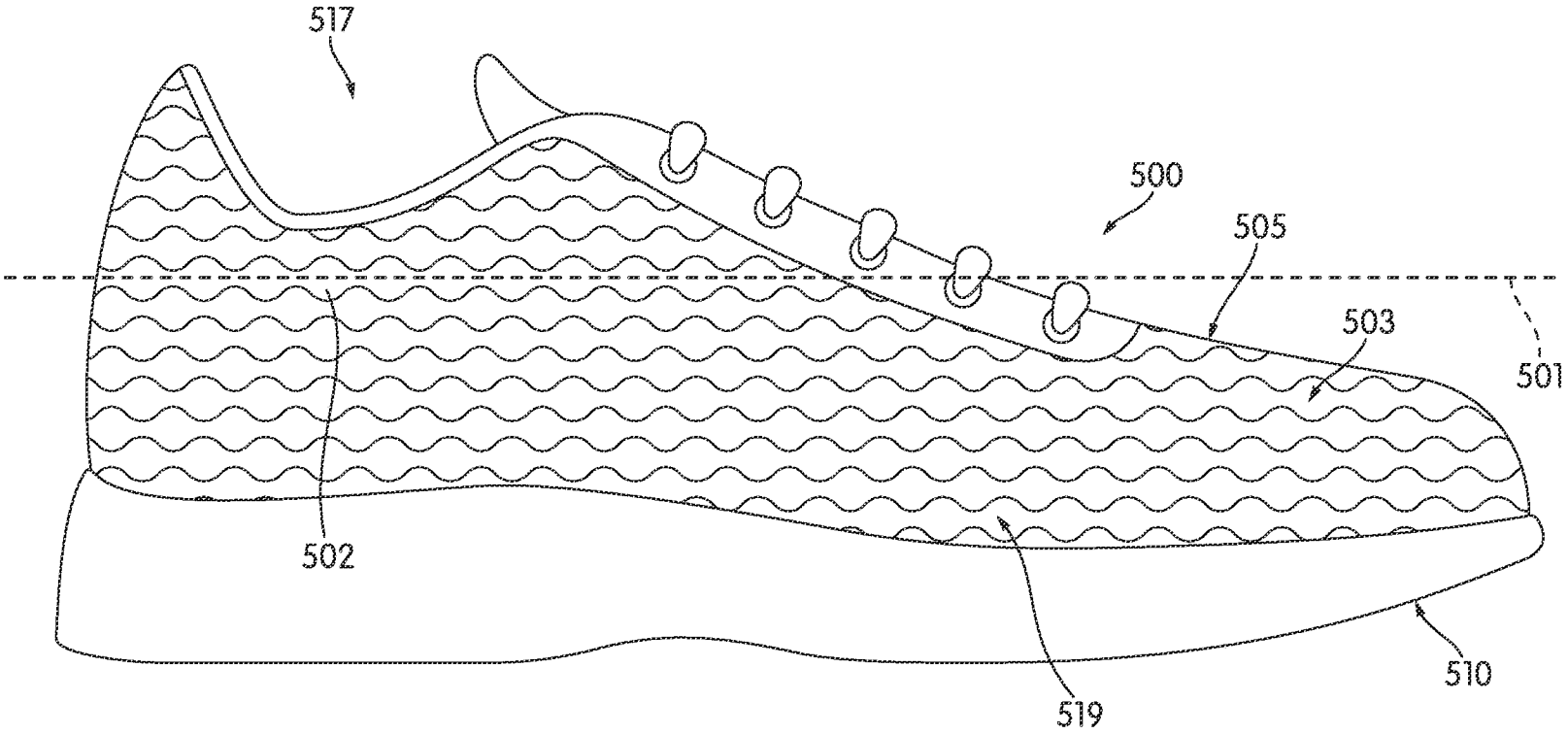
FIG. 13 shows a side view of a multi-layer upper with a pattern of strips with undulating edges, where the strip axes are parallel to the longitudinal axis of the article of footwear.

In some embodiments, such as in FIG. 1, the strips may form an angle 130 with a longitudinal axis 101 of article of footwear 100. In the embodiment shown in FIG. 1, angle 130 is negative and acute. In other embodiments, the angles may vary. FIG. 13 shows an embodiment of a second medial side 519 of a second article of footwear 500. Second article of footwear 500 includes a second multi-layer upper 505 associated with a second sole structure 510. Second multi-layer upper 505 includes a fifth cut material 503 with a pattern of undulating strips. In this embodiment, the undulating strips, such as eleventh strip 502 is positioned substantially parallel to second longitudinal axis 501.

Figure 14:
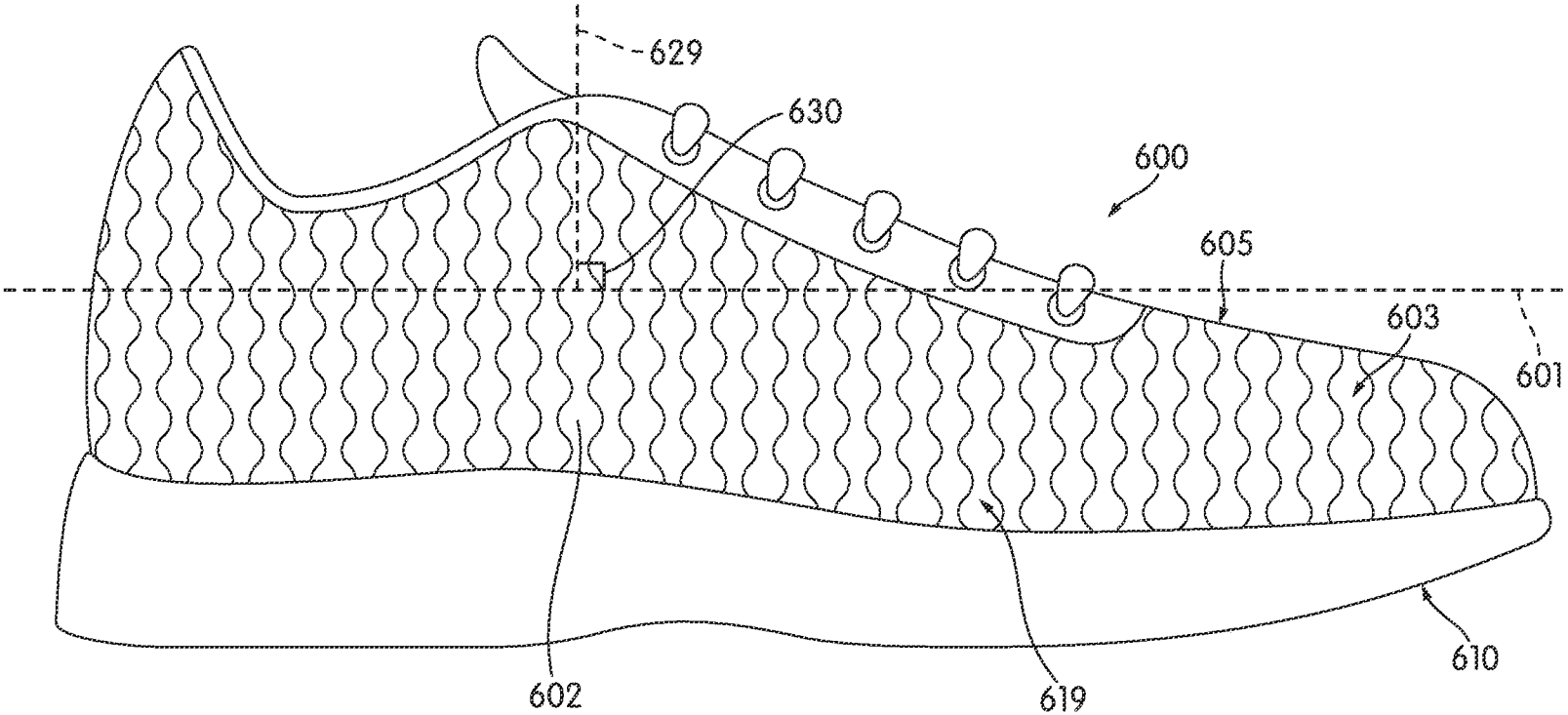
FIG. 14 shows a side view of a multi-layer upper with a pattern of strips with undulating edges, where the strip axes are perpendicular to the longitudinal axis of the article of footwear.

FIG. 14 shows an embodiment of a third medial side 619 of a third article of footwear 600. Third article of footwear 600 includes a third multi-layer upper 605 associated with a third sole structure 610. Third multi-layer upper 605 includes a sixth cut material 603 with a pattern of undulating strips. In this embodiment, the undulating strips, such as twelfth strip 602 having a strip axis 629, is positioned substantially parallel to fourth longitudinal axis 601.

In some embodiments, various components may be provided to further constrain the movement of the cut portions of the multi-layer uppers. Components may be additional pieces of material, such as textiles, relatively inflexible plastic pieces, flexible plastic pieces or films, or the like. For example, in the embodiment shown in FIG. 1, a toe cap 129 may be provided. Toe cap 129 may be a plastic film heat bonded or otherwise adhered to the toe of article of footwear 100 to provide additional abrasion resistance to the toe. Toe cap 129 may be positioned onto cut portions of upper 105 or on uncut portions of upper 105. If positioned over cut portions, toe cap 129 may further restrict the relative movement of adjacent strips for enhanced stability.

Figure 15:
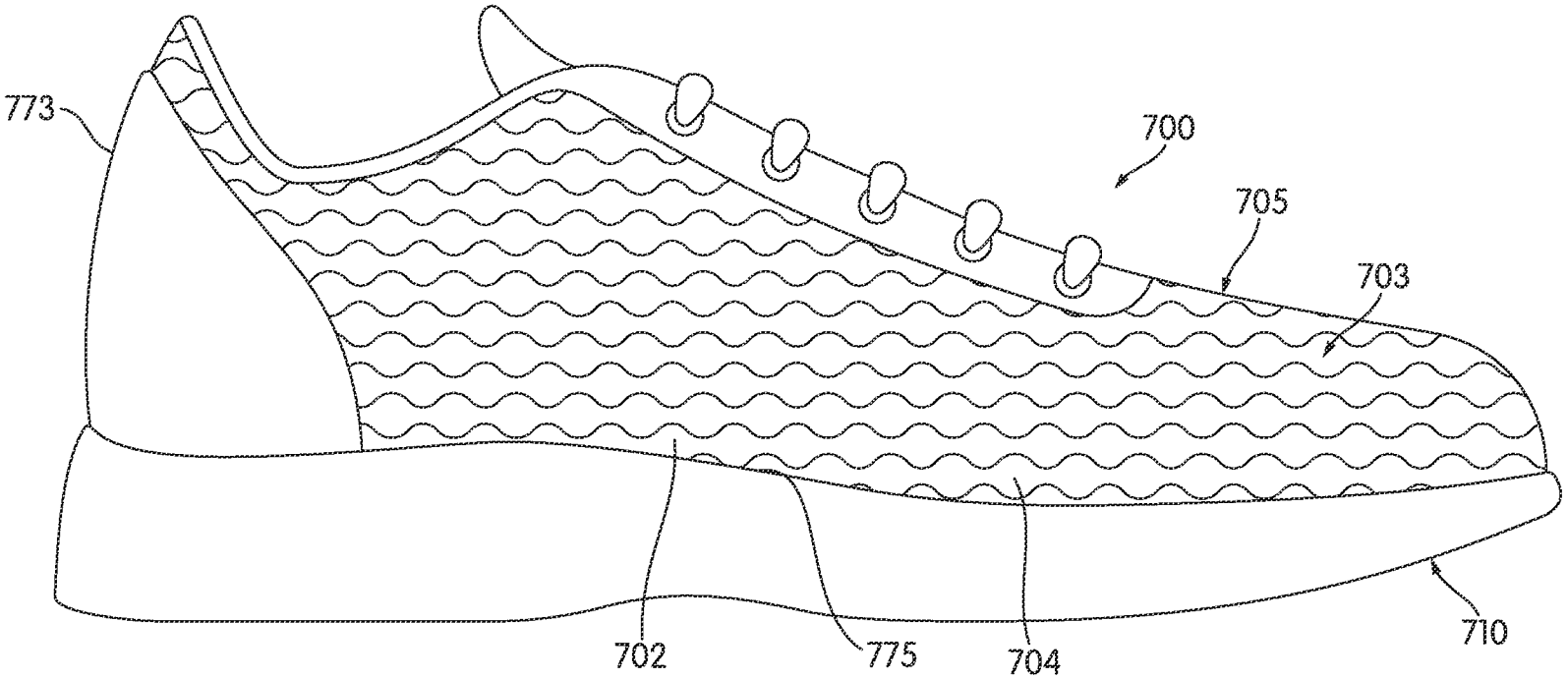
FIG. 15 shows a side view of a multi-layer upper with a pattern of strips with undulating edges, where the strip axes are parallel to the longitudinal axis of the article of footwear and a heel cup covers a portion of at least some of the strips.

FIG. 15 shows an embodiment of a fifth medial side of a fifth article of footwear 700. Fifth article of footwear 700 includes a fifth multi-layer upper 705 associated with a fifth sole structure 710. Fifth multi-layer upper 705 includes an eighth cut material 703 with a pattern of undulating strips. Fifth article of footwear also includes a heel cup 773 positioned on top of the undulating strips. Heel cup 773 may further restrict the relative movement of adjacent strips for enhanced stability and comfort of the heel of a wearer. Similarly, fifth sole structure may also partially overlap strips. In the embodiment shown in FIG. 15, a portion of fifth sole structure 710 is positioned on top and optionally adhered to the strips such as fourteenth strip 702 and fifteenth strip 704. Adjacent strips such as fourteenth strip 702 and fifteenth strip 704 are thus constrained in relative motion to each other by fifth sole structure 710 at sole-upper interface 775. This constraint may increase stability of upper 705 at sole-upper interface 775.

Figure 16:
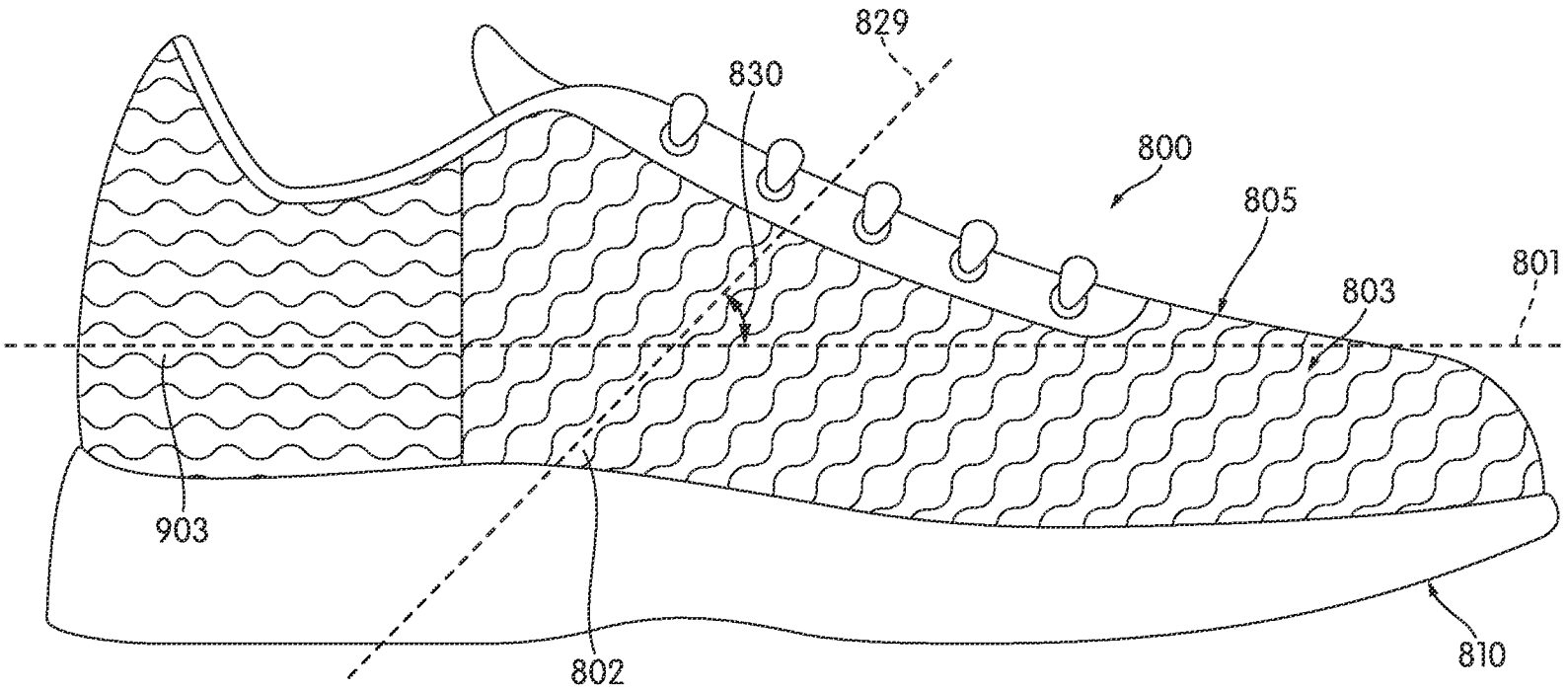
FIG. 16 shows a side view of a multi-layer upper with a pattern of strips with undulating edges, where the heel region strip axes are parallel to the longitudinal axis of the article of footwear and the strip axes are at an angle with respect to the longitudinal axis of the article of footwear in the midfoot and forefoot regions.

FIG. 16 shows an embodiment of a fourth medial side 819 of a fourth article of footwear 800. Fourth article of footwear 800 includes a fourth multi-layer upper 805 associated with a fourth sole structure 810. Fourth multi-layer upper 805 includes a seventh cut material 803 with a pattern of undulating strips. In this embodiment, the undulating strips, such as thirteenth strip 802 having a second strip axis 829, may be positioned at a second angle 830 to fifth longitudinal axis 801. In this embodiment, seventh cut material 803 is positioned in a second midfoot region 809 and a second forefoot region 807. A second heel region 811 includes an eighth cut material 903 with a pattern of undulating strips. In eighth cut material 903, the axes of the undulating strips are substantially parallel to fifth longitudinal axis 801.

While various embodiments of the invention have been described, the description is intended to be exemplary, rather than limiting and it will be apparent to those of ordinary skill in the art that many more embodiments and implementations are possible that are within the scope of the invention. Any feature of any embodiment may be used in combination with or substituted for any other feature or element in any other embodiment unless specifically restricted. Accordingly, the invention is not to be restricted except in light of the attached claims and their equivalents. Also, various modifications and changes may be made within the scope of the attached claims.

What is claimed is:

1. An upper for an article of footwear, the upper comprising:

a first fabric layer;

a second fabric layer; and a compressible material layer positioned between the first fabric layer and the second fabric layer, wherein the upper comprises a plurality of cut portions of upper material formed by a plurality of separations cut into the first fabric layer and the compressible material layer while the second fabric layer remains intact to form a substrate for the plurality of cut portions, wherein the plurality of separations includes a first separation defined between a first edge of a first cut portion of the plurality of cut portions and a second edge of a second cut portion of the plurality of cut portions such that the first edge of the first cut portion and the second edge of the second cut portion form opposite walls of the first separation extending inward from an outer surface of the upper, wherein the first edge of the first cut portion follows a first undulate pattern comprising a first plurality of repeating undulations forming a wavy, sinusoidal shape, wherein the second edge of the second cut portion follows a second undulate pattern that matches the first undulate pattern of the first edge and comprises a second plurality of repeating undulations forming a wavy, sinusoidal shape that match the first plurality of repeating undulations such that the first separation has an undulate pattern defined by the first undulate pattern of the first edge and the second undulate pattern of the second edge, and wherein, in an unflexed configuration, the first edge of the first cut portion abuts the second edge of the second cut portion, and, in a flexed configuration, the first edge is separated from the second edge.

2. The upper of claim 1, wherein the plurality of separations form a pattern on the upper that is visible on the outer surface of the upper.

3. The upper of claim 1, wherein the first fabric layer forms the outer surface of the upper.

4. The upper of claim 1, wherein the first separation separates a first strip of the upper material from a second strip of the upper material located adjacent the first strip, and wherein the first strip and the second strip form a negative and acute angle with respect to a longitudinal axis of the upper.

5. The upper of claim 1, wherein the wavy, sinusoidal shape of the first edge includes plural peaks and plural troughs evenly separated along a length of the first edge, and wherein the wavy, sinusoidal shape of the second edge includes plural peaks and plural troughs evenly separated along a length of the second edge.

6. The upper of claim 1, wherein the first fabric layer and the second fabric layer are made of a same material.

7. The upper of claim 1, wherein the first edge and the second edge form a juncture at an innermost point of the first separation such that when the upper is in the flexed configuration, the first edge is separated from the second edge to form the first separation as a V-shaped gap between the first cut portion and the second cut portion, wherein the gap is widest proximate the first fabric layer.

8. The upper of claim 1, wherein the plurality of separations form plural strips of upper material that extend in a direction parallel to a longitudinal axis of the upper.

9. The upper of claim 1, wherein the first fabric layer, the second fabric layer, and the compressible material layer extend over a heel region, a midfoot region, and a forefoot region of the upper on medial and lateral sides of the upper, and wherein the plurality of cut portions extend within the heel region, the midfoot region, and the forefoot region of the upper on the medial and lateral sides of the upper.

10. The upper of claim 9, wherein the upper includes a throat opening configured to permit insertion and withdrawal of a user's foot, and wherein at least one of the plurality of separations extends to the throat opening.

11. An article of footwear comprising:

an upper including:

a first fabric layer cut into a plurality of fabric portions, a second fabric layer, and a foam layer disposed between the first fabric layer and the second fabric layer, wherein the foam layer is cut into a plurality of foam portions, wherein each of the fabric portions corresponds to and is connected to a corresponding one of the foam portions to form a plurality of cut portions of upper material with a plurality of separations between the cut portions, wherein the plurality of separations includes a first separation defined between a first edge of a first cut portion of the plurality of cut portions and a second edge of a second cut portion of the plurality of cut portions such that the first edge of the first cut portion and the second edge of the second cut portion form opposite walls of the first separation extending inward from an outer surface of the upper, wherein the first edge of the first cut portion follows a first undulate pattern comprising a first plurality of repeating undulations forming a wavy, sinusoidal shape, wherein the second edge of the second cut portion follows a second undulate pattern that matches the first undulate pattern of the first edge and comprises a second plurality of repeating undulations forming a wavy, sinusoidal shape that match the first plurality of repeating undulations such that the first separation has an undulate pattern defined by the first undulate pattern of the first edge and the second undulate pattern of the second edge, wherein, in an unflexed configuration, the first edge of the first cut portion abuts the second edge of the second cut portion, and, in a flexed configuration, the first edge is separated from the second edge, wherein the first fabric layer forms the outer surface of the upper, the second fabric layer forms an intact substrate that supports the plurality of cut portions, and wherein the first fabric layer, the second fabric layer, and the foam layer extend over a heel region, a midfoot region, and a forefoot region of the upper on medial and lateral sides of the upper, and wherein the plurality of separations includes separations that extend within the heel region, the midfoot region, and the forefoot region of the upper on the medial and lateral sides of the upper; and a sole coupled to the upper.

12. The article of footwear of claim 11, wherein substantially all of the upper includes the cut portions that form a pattern on the outer surface of the upper.

13. The article of footwear of claim 11, wherein the first edge and the second edge form a juncture at an innermost point of the first separation such that when the upper is in the flexed configuration, the first edge is separated from the second edge to form the first separation as a V-shaped gap between the first cut portion and the second cut portion, wherein the gap is widest proximate the first fabric layer.

14. The article of footwear of claim 11, wherein the foam layer is made of an open-cell polyurethane material having a thickness between 3 mm and 5 mm.

15. The article of footwear of claim 11, wherein the wavy, sinusoidal shape of the first edge includes plural peaks and plural troughs evenly separated along a length of the first edge, and wherein the wavy, sinusoidal shape of the second edge includes plural peaks and plural troughs evenly separated along a length of the second edge.

16. The article of footwear of claim 11, wherein the plurality of separations form plural strips of upper material that extend in a direction parallel to a longitudinal axis of the upper.

17. The article of footwear of claim 11, wherein the plurality of separations form plural strips of upper material that extend in directions that form a negative and acute angle with respect to a longitudinal axis of the upper.

18. An article of footwear comprising:

an upper configured to extend over instep and toe areas of the foot, along medial and lateral sides of the foot, and around a heel area of the foot, wherein the upper comprises:

a first fabric layer cut into a first fabric portion and a second fabric portion, a second fabric layer, and a foam layer disposed between the first fabric layer and the second fabric layer, wherein the foam layer is cut into a first foam portion and a second foam portion, wherein the first fabric portion is fixed to the first foam portion to form a first cut portion of upper material and the second fabric portion is fixed to the second foam portion to form a second cut portion of the upper material, wherein a first separation is defined between a first edge of the first cut portion and a second edge of the second cut portion such that the first edge of the first cut portion and the second edge of the second cut portion form opposite walls of the first separation extending inward from an outer surface of the upper, wherein the first edge of the first cut portion follows a first undulate pattern comprising a first plurality of repeating undulations forming a wavy, sinusoidal shape, wherein the second edge of the second cut portion follows a second undulate pattern that matches the first undulate pattern of the first edge and comprises a second plurality of repeating undulations forming a wavy, sinusoidal shape that match the first plurality of repeating undulations such that the first separation has an undulate pattern defined by the first undulate pattern of the first edge and the second undulate pattern of the second edge, and wherein the first edge and the second edge form a juncture at an innermost point of the first separation such that when the upper is in a flexed configuration, the first edge is separated from the second edge to form the first separation as a V-shaped gap between the first cut portion and the second cut portion, wherein the gap is widest proximate the first fabric layer; and a sole coupled to the upper.

19. The article of footwear of claim 18, wherein the foam layer comprises foamed polyurethane having a thickness between 1 mm and 10 mm.

20. The article of footwear of claim 18, wherein the wavy, sinusoidal shape of the first edge includes plural peaks and plural troughs evenly separated along a length of the first edge, and wherein the wavy, sinusoidal shape of the second edge includes plural peaks and plural troughs evenly separated along a length of the second edge.

* * * * *